US009307625B2

(12) United States Patent
Rollinger et al.

(10) Patent No.: US 9,307,625 B2
(45) Date of Patent: Apr. 5, 2016

(54) DROPLET DISPENSING DEVICE AND LIGHT SOURCE COMPRISING SUCH A DROPLET DISPENSING DEVICE

(75) Inventors: Bob Rollinger, Zurich (CH); Reza Abhari, Forch (CH); Andrea Giovannini, Lugano (CH); Ian Henderson, Zurich (CH)

(73) Assignee: ETH Zurich, Zurich (CH)

( * ) Notice: Subject to any disclaimer, the term of this patent is extended or adjusted under 35 U.S.C. 154(b) by 191 days.

(21) Appl. No.: 14/110,048

(22) PCT Filed: Apr. 2, 2012

(86) PCT No.: PCT/EP2012/001453

§ 371 (c)(1),
(2), (4) Date: Dec. 13, 2013

(87) PCT Pub. No.: WO2012/136343

PCT Pub. Date: Oct. 11, 2012

(65) Prior Publication Data

US 2014/0151582 A1 Jun. 5, 2014

(30) Foreign Application Priority Data

Apr. 5, 2011 (EP) ..... 11002817

(51) Int. Cl.
*H05G 2/00* (2006.01)
*B05B 1/02* (2006.01)
*B05B 17/06* (2006.01)

(52) U.S. Cl.
CPC *H05G 2/008* (2013.01); *B05B 1/02* (2013.01); *B05B 17/0623* (2013.01); *H05G 2/005* (2013.01); *H05G 2/006* (2013.01)

(58) Field of Classification Search
USPC ..... 250/504 R
See application file for complete search history.

(56) References Cited

U.S. PATENT DOCUMENTS

| | | | |
|---|---|---|---|
| 3,328,610 | A | 6/1967 | Jacke et al. |
| 5,015,423 | A | 5/1991 | Eguchi et al. |
| 5,171,360 | A | 12/1992 | Orme et al. |
| 5,598,200 | A | 1/1997 | Gore |
| 6,224,180 | B1 | 5/2001 | Pham-Van-Diep et al. |
| 6,395,216 | B1 | 5/2002 | Jameson |

(Continued)

FOREIGN PATENT DOCUMENTS

| | | | |
|---|---|---|---|
| EP | 0186491 | A2 | 7/1986 |
| JP | 2001228060 | A | 8/2001 |

(Continued)

OTHER PUBLICATIONS

Hertz, et al. Debris-free Soft X-Ray Generation Using a Liquid Droplet Laser-Plasma Target, SPIE, 2011, 88-93, 2523.

(Continued)

*Primary Examiner* — Kiet T Nguyen
(74) *Attorney, Agent, or Firm* — The Webb Law Firm

(57) ABSTRACT

A droplet dispensing device includes a reservoir for receiving a liquid material, an outlet nozzle in fluid communication with the reservoir and a piezoelectric actuating means acting on the liquid material at the outlet nozzle to exit the outlet nozzle in a sequence of droplets. A piezoelectric actuating means that includes a piston, which is actuated by a piezoelectric actuator at one end and dips the other, free end into the liquid material is provided just upstream of the outlet nozzle.

22 Claims, 4 Drawing Sheets

(56) References Cited

U.S. PATENT DOCUMENTS

| | | | | |
|---|---|---|---|---|
| 6,450,416 | B1 | 9/2002 | Berg et al. | |
| 6,647,088 | B1 | 11/2003 | Schmidt et al. | |
| 6,773,927 | B2 | 8/2004 | Osawa et al. | |
| 7,750,327 | B2 | 7/2010 | Tran et al. | |
| 2009/0230326 | A1 | 9/2009 | Vaschenko et al. | |
| 2010/0090133 | A1 | 4/2010 | Endo et al. | |
| 2013/0146682 | A1 * | 6/2013 | Ishihara et al. | 239/590 |

FOREIGN PATENT DOCUMENTS

| | | | |
|---|---|---|---|
| JP | 2007142306 | A | 6/2007 |
| JP | 2008070583 | A | 3/2008 |
| JP | 2008300351 | A | 12/2008 |
| JP | 2010106321 | A | 5/2010 |
| WO | 2006093687 | A1 | 9/2006 |

OTHER PUBLICATIONS

Orme et al. New Technique for Producing Highly Uniform Droplet Streams Over an Extended Range of Disturbance Wavenumbers, Rev. Sci. Instrum., Feb. 1987, 279-284, 58 (2).

Schwenn et al. A Continuous Droplet Source for Plasma Production with Pulse Lasers, Journal of Physics E: Scientific Instruments, 1974, 715-718, 7.

* cited by examiner

DROPLET DISPENSING DEVICE AND LIGHT SOURCE COMPRISING SUCH A DROPLET DISPENSING DEVICE

CROSS-REFERENCE TO RELATED APPLICATIONS

This application is the United States national phase of International Application No. PCT/EP2012/001453 filed Apr. 2, 2012, and claims priority to European Patent Application No. 11002817.2 filed on Apr. 5, 2011, the disclosures of which are hereby incorporated by reference in their entirety.

BACKGROUND OF THE INVENTION

1. Field of the Invention

The present invention relates to the technical field of generating droplets and, more particularly to a droplet dispensing device. It further refers to a light source comprising such a droplet dispensing device.

2. Description of Related Art

In different technical fields it is necessary to generate a continuous sequence of droplets of a predetermined size and droplet frequency, which is ejected on a predetermined trajectory. The material of the droplets may for example be a liquid solution or a molten metal. One technical field, where such a droplet dispensing device is used, is a light source emitting extreme ultraviolet or soft x-ray light.

Extreme ultraviolet (EUV) light is electromagnetic radiation with wavelengths between 121 nm and 10 nm, while soft x-rays range from 10 nm to 1 nm. In EUV or soft x-ray sources, a radiation emitting plasma is produced by irradiating a target material. A regenerative solution for delivering target material to the production site comprises a target dispensing device based on liquid droplets. The radiation exciting the target material can be a pulsed laser beam, thus producing a laser produced plasma (LPP). The target delivery must be synchronized with the pulsed laser beam. The radiation is typically collected and directed to an intermediate region for utilization outside of the light source.

The formation and delivery of the target material to the focus of the light collector is closely linked to thermal and fluid management, as well as droplet generation issues of the dispensing device.

A method for creating continuous droplet streams with a vibrator coupled to an injection nozzle is disclosed in H. M. Hertz et al., "Debris free soft x-ray generation using a liquid droplet laser plasma target", U.S., SPIE, Vol. 2523, pp. 88-93, with application in a soft x-ray light source. Another method, based on magnetic coil vibrators is disclosed in "A continuous droplet source for plasma production with pulse lasers", U.K., Journal of Physics E: Scientific instruments, Vol. 7, 1974, pp. 715-718.

Other dispensing systems are used in soldering applications, such as the apparatus shown in document U.S. Pat. No. 5,171,360, which produces a stream of metal droplets at a temperature of 200° C. A similar droplet generator developed is disclosed in Rev. Sci. Instr. 58 (1987) 279. Another typical continuous or on-demand soldering jetting device is disclosed in document U.S. Pat. No. 6,224,180. A method and apparatus to generate on-demand droplets by acoustic impulses, including an impulse transmitting device inside liquid metal, is disclosed in document U.S. Pat. No. 5,598, 200.

Document EP 0 186 491 discloses an apparatus for producing soft x-rays from generating a plasma source which comprises a low pressure vessel, energy beam means, such as a laser beam, associated with the low pressure vessel for generating and supplying a high energy beam to an impact area inside the low pressure vessel, a liquid target, such as mercury, capable of emitting x-rays when impacted by a high energy beam target supply means associated with the low pressure vessel for supplying the liquid target material to the impact area inside the low pressure vessel, and control means coupled to the energy beam means so that the high energy beam impacts the liquid material target in the impact area of the low pressure vessel. The mercury drops are formed at the end of a fine tube in a vessel by the action of surface tension and are caused to drop by vibration set up by a piezoelectric element, which is connected to the fine tube (see also US 2009/0230326 or US 2010/0090133).

Document WO 2006/093687 discloses an EUV light source plasma source material handling system and method, which may comprise a droplet generator having droplet generator plasma source material reservoir in fluid communication with a droplet formation capillary and maintained within a selected range of temperatures sufficient to keep the plasma source material in a liquid form; a plasma source material supply system having a supply reservoir in fluid communication with the droplet generator plasma source material reservoir and holding at least a replenishing amount of plasma source material in liquid form for transfer to the droplet generator plasma source material reservoir, while the droplet generator is on line; a transfer mechanism transferring liquid plasma source material from the supply reservoir to the droplet generator plasma source material reservoir, while the droplet generator is on line.

The droplet dispensing devices known so far have the disadvantage that the droplet size and trajectory are not precise enough to generate extreme ultra-violet or soft x-ray radiation in a laser-driven light source with improved efficiency.

SUMMARY OF THE INVENTION

It is an object of the invention, to create a droplet dispensing device with improved precision of the droplet size and trajectory even when the liquid used is a molten material from a heated reservoir.

It is another object of the invention to have a light source with an improved efficiency.

The droplet dispensing device according to the invention comprises a reservoir to for receiving a liquid material, an outlet nozzle in fluid communication with said reservoir and a piezoelectric actuating means acting on said liquid material at said outlet nozzle to exit said outlet nozzle in a sequence of droplets. It is characterised by said piezoelectric actuating means comprising a piston, which is actuated by a piezoelectric actuator at one end and dips the other, free end into said liquid material just upstream of said outlet nozzle.

According to an embodiment of the invention said liquid material is a molten material and said reservoir is heated by a heating means to keep said molten material in the molten state.

According to another embodiment of the invention said reservoir is surrounded by an outer cylinder and said heating means comprises a resistive heater, which is wound around said outer cylinder and preferably said outlet nozzle and thermally and mechanically fixed to said outer cylinder, especially by means of laser welding.

According to another embodiment of the invention said reservoir and preferably said outlet nozzle are enclosed by a band-heater. According to another embodiment of the invention a filter is provided upstream of the outlet nozzle.

According to another embodiment of the invention said outlet nozzle, said actuated piston and said filter, respectively, are detachably coupled to said reservoir.

According to another embodiment of the invention said outlet nozzle is configured to deliver a continuous stream of droplets of said liquid material at a desired frequency when said actuated piston is periodically excited by means of said piezoelectric actuator.

According to another embodiment of the invention said outlet nozzle comprises a separate nozzle disk, which is retained in a nozzle casing and is detachably coupled to said reservoir by a clamping device.

According to another alternative embodiment of the invention said outlet nozzle comprises a one-piece nozzle unit, which is detachably coupled to said reservoir by a clamping device.

According to another embodiment of the invention said nozzle disk or nozzle unit, respectively, are made of a metal or ceramic and comprise a micromachined nozzle orifice.

According to another embodiment of the invention means for applying a pressure to the liquid material in the reservoir is provided, so that said liquid material is urged from the reservoir into said outlet nozzle.

Preferably, said pressure applying means comprises a connector tube leading to the interior of said reservoir.

According to just another embodiment of the invention said reservoir comprises a cover at a side opposite to said outlet nozzle, said actuated piston is mounted on said cover, and said piezoelectric actuator is arranged between said cover and said actuated piston to generate displacements of said actuated piston in to order to induce pressure waves in the liquid material at the outlet nozzle to impose a desired frequency to said sequence of droplets.

According to another embodiment of the invention said reservoir is suspended at a side opposite to said outlet nozzle in a casing by means of a thermally insulating flange and said piezoelectric actuator is arranged between the flange and the casing.

According to another embodiment of the invention said reservoir is provided with a cooling system for cooling the piezoelectric actuator to maintain the temperature of the piezoelectric actuator below detrimental temperatures.

Preferably, said cooling system is arranged outside said heated reservoir with a defined heat path to said piezoelectric actuator.

According to another embodiment of the invention a mechanical preload mechanism is provided for said piezoelectric actuator.

According to another embodiment of the invention a heat shield is provided for at least part of said piston, which reduces the heat flux from the liquid material to said piezoelectric actuator.

According to just another embodiment of the invention said reservoir and said outlet nozzle are part of replaceable cartridge, which is arranged in a casing and which is thermally insulated from said casing by insulating means, preferably by insulating flanges.

The light source for producing extreme ultraviolet or soft x-ray light according to the invention comprises a chamber that contains a production site for producing extreme ultraviolet or soft x-ray light, a droplet dispensing device for dispensing droplets of a liquid material into said production site, the liquid material being capable of radiating extreme ultraviolet or soft x-ray light when excited into a higher energy state, and irradiating means for irradiating the droplets at said production site. It is characterized by said droplet dispensing device being a is droplet dispensing device according to the invention.

BRIEF DESCRIPTION OF THE DRAWINGS

The present invention is now to be explained more closely by means of different embodiments and with reference to the attached drawings.

DETAILED DESCRIPTION OF DIFFERENT EMBODIMENTS OF THE INVENTION

The invention is directed to a droplet dispensing device which can be used for various purposes. The invention also encompasses a light source, comprising a production chamber that contains a light production site, a droplet dispensing device for dispensing droplets of a material into the production site, the material being capable of radiating in the target wavelength window when excited into a higher energy state, and irradiating means for irradiating the droplets in the production site. Said droplet dispensing device is a droplet dispensing device according to the invention.

In one embodiment the material reservoir and nozzle may be heated using an electrical heating resistance. Droplet generation is achieved by an actuated piston inside the material reservoir. The excitation source of said piston is a piezoelectric actuator. The piston may be provided with a cooling system and a heat shield for said actuator. The material reservoir may be a replaceable and refillable cartridge with a backpressure connector. A filter may be placed upstream of the outlet nozzle in order to avoid clogging of the outlet nozzle. The outlet nozzle may have a micro-machined orifice. The dispensing unit may be supported by thermally insulating flanges in order to reduce the outer dispenser casing temperature. Instead of actuating the piston directly, the desired droplet train frequency may be imposed by displacing the dispensing unit relative to the casing via piezoelectric actuators.

Figure 1:
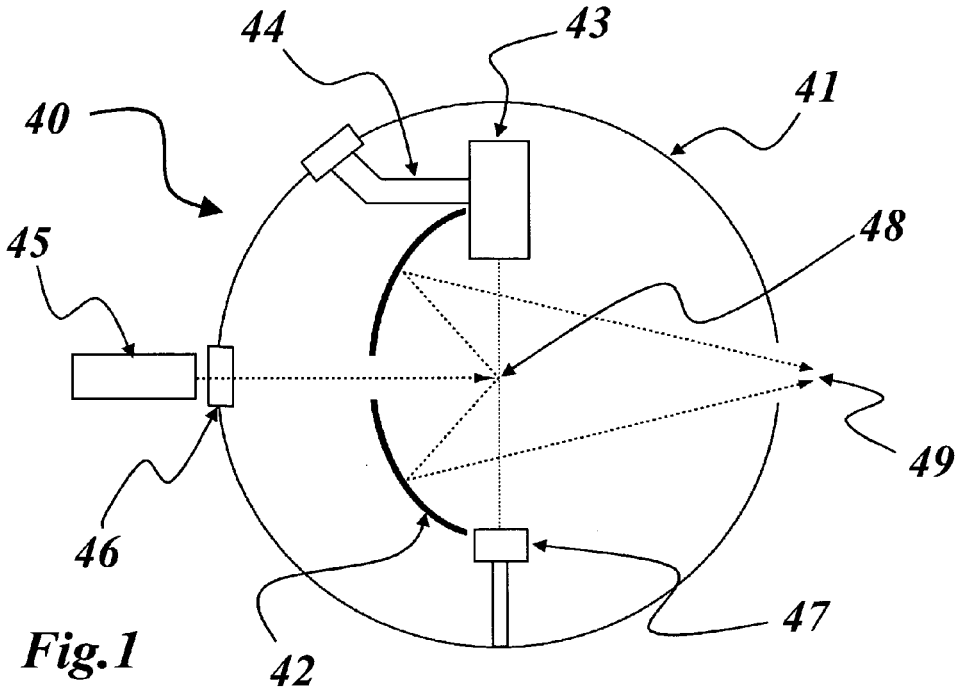
FIG. 1 shows a simplified sectional view through a light source, including an embodiment of a target dispensing device according to the invention.

FIG. 1 shows a light source 40, which comprises chamber 41 containing collection optics or collector 42 for extreme ultra-violet (EUV) or soft x-ray light and a target or droplet dispensing or delivery device 43 as disclosed in this document. A drive laser 45 ignites the target material at a light production site 48. The focused drive laser pulse is brought into the chamber 41 through a flanged window 46. The spatial and temporal characteristics of the laser pulse should match the target size and location in order to maximize conversion efficiency, i.e., the ratio of desired light emission and laser energy.

The collector 42 may be an elliptical reflector, e.g., an elliptical EUV or soft x-ray (e.g., Mo/Si) mirror, with a first focus at the production site 48 and a second focus, called intermediate focus (IF), at an intermediate focus location 49, where the light is bundled for further use in an outside tool (not shown). The collector 42 has an aperture for the laser light to reach the light production site 48. The collector 42 may be replaced by a set of collection optics, which also bundles the light for further use. A catcher 47 catches the droplets or remains passing the production site 48.

The target or droplet dispensing device 43, which is mounted to the chamber 41 by means of a fixture 44, delivers the plasma source material in form of a sequence or stream of droplets to the ignition or production site 48. The liquid source material can be chosen by the skilled artisan in accordance with the requirements. It may either be liquid droplets of metals, e.g., Sn, Li, In, Ga, Na, K, Mg, Ca, Hg, Cd, Se, Gd, Tb, and alloys of these metals, e.g. SnPb, SnIn, SnZnIn, SnAg, liquid non-metals, e.g. Br, liquefied gases, e.g. Xe, $N_2$ and Ar, or a suspension of a target material in a solution, e.g., in water or alcohol. In terms of requirements for the droplet dispensing device 43, the delivery of the source material may be at constant repetition rate (frequency) and target (droplet) size. Target sizes are in the range of 5 to 100 μm in order to minimize the amount of neutral particles after plasma formation, as well as the amount of residual source material.

Deviations in the location of the target imply a drop in conversion efficiency, as the target material is ignited either not at all or incompletely. Therefore, conversion efficiency is a function of the target delivery accuracy.

Figure 2:
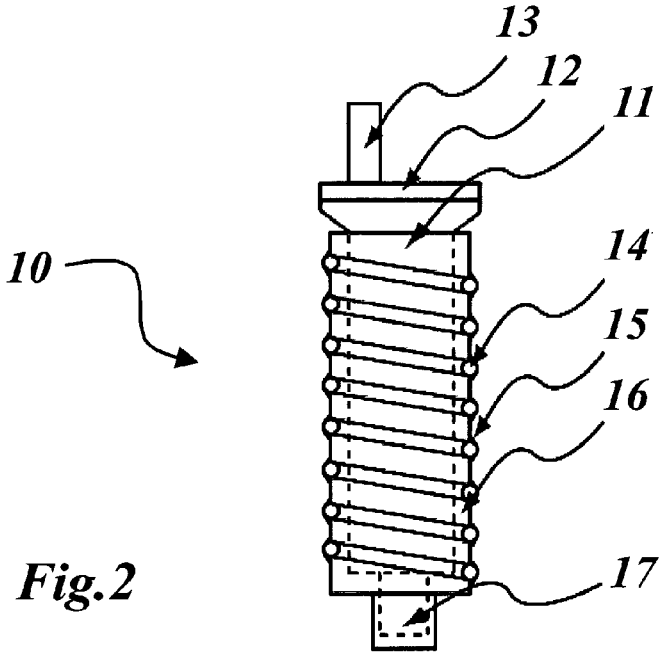
FIG. 2 shows a schematic view of dispensing device, including a material reservoir and an outlet nozzle, according to an embodiment of the invention.

Turning now to FIG. 2, the core of the droplet dispensing device 10 may consist of a replaceable cartridge, including a material reservoir 11. The source material reservoir 11 is preferably refillable and equipped with a removable cover 12. The reservoir 11 may be of cylindrical shape for manufacturing and uniform heating reasons. A backpressure connector tube 13 is located on the removable cover 12 of the cartridge. The backpressure connector tube 13 connects the material cartridge to a gas feed through flange (not shown) at the chamber 41. A compressed gas source (not shown) can be connected on that way to the source material reservoir 11. By inserting a pressure regulator between the gas source and the droplet dispensing device 10, the pressure can be adjusted. A typical gas source may be a compressed gas tank, e.g. for Ar, N, Kr or He. The backpressure gas induces a jet discharge at the exit of an outlet nozzle 17, which is in fluid connection with the reservoir 11.

The cartridge with its reservoir 11 may be heated using an electrical heating resistance or resistive heater 14. The resistive heater 14 may be wound around an outer cylinder 16 containing the replaceable cartridge. The heater winding should extend over the full length of the cylinder 16 in order to ensure uniform heat transfer to the source material within the reservoir 11. The heating system may be extended to include the outlet nozzle 17. As shown in FIG. 2, the resistive heater 14 may be contained in a groove and may be fixed by a laser welding 15 to the cylinder 16 containing the cartridge. The reason for this positive fit of the resistive heater 14 lies in the high vacuum environment in which the dispensing device 10 may be operated. Indeed, no natural convection can make uniform hot spots in a high-vacuum environment. An insufficient fit of the resistive heater 14 easily leads to damage (burning) of the heating tube.

Alternatively the heating system may be part of the cartridge. The heating system may be based on a band heater enclosing the source material reservoir 11 and the outlet nozzle 17. The heating power of the resistive heater 14 may be adjusted by a microprocessor or microcontroller (not shown). Temperature sensors (not shown) for monitoring the temperature may be installed on the dispensing device 10. Their temperature signals can be used for a heating control system and/or an emergency shutdown system.

Figure 3:
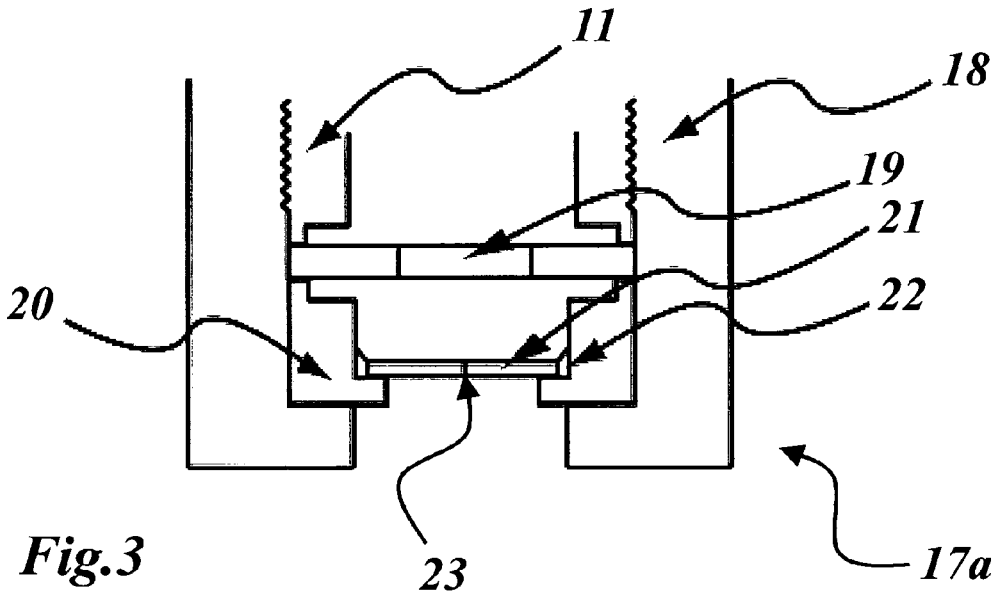
FIG. 3 shows a schematic cross-sectional view of a two part outlet nozzle, including a filter assembly, according to an embodiment of the invention.

Turning now to FIG. 3, the outlet nozzle 17*a* may comprise a nozzle casing 20 and a nozzle disk 21 with a nozzle orifice 23. The nozzle disk 21 may be permanently attached to the nozzle casing 20. The attachment and sealing 22 may be realized by applying a high temperature epoxy, a high temperature silicon based glue, a glass sealing or diffusion bonding.

Figure 4:
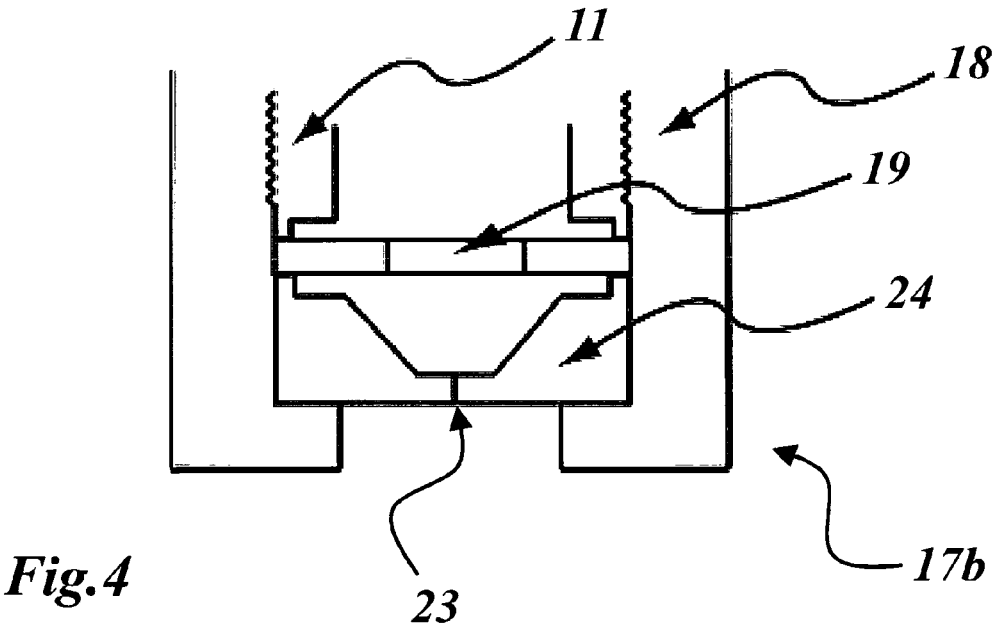
FIG. 4 shows a schematic cross-sectional view of single part outlet nozzle, including a filter assembly, according to another embodiment of the invention.

Alternatively, the nozzle casing and disk may form one single nozzle unit 24, as shown in the outlet nozzle 17*b* of FIG. 4.

The material of the nozzle disk 21 or nozzle unit 24 may be a micro-machinable ceramic, e.g. aluminium oxide, diamond, Macor, sapphire, Shapal M, silicon nitride, metal, e.g. aluminium, brass, stainless steel, tungsten. The nozzle material should give low geometric tolerances on quality of the nozzle orifice 23 and should have low wetting by the source or droplet material. The nozzle channel within the nozzle orifice 23 may be tapered, staged or streamlined for manufacturing reasons or improved inflow conditions.

The nozzle casing 20 may be attached to the material reservoir 11 via a standard pipe fitting. The gasket for the fitting may include a filter 19, e.g. sintered stainless steel, with pore sizes from 0.1 to 20 μm. Alternatively, the filter 19 may be placed further upstream of the nozzle. The outlet nozzle 17, 17*a,b* may be attached by a clamping device 18, e.g. a nut known in the art.

Figure 5:
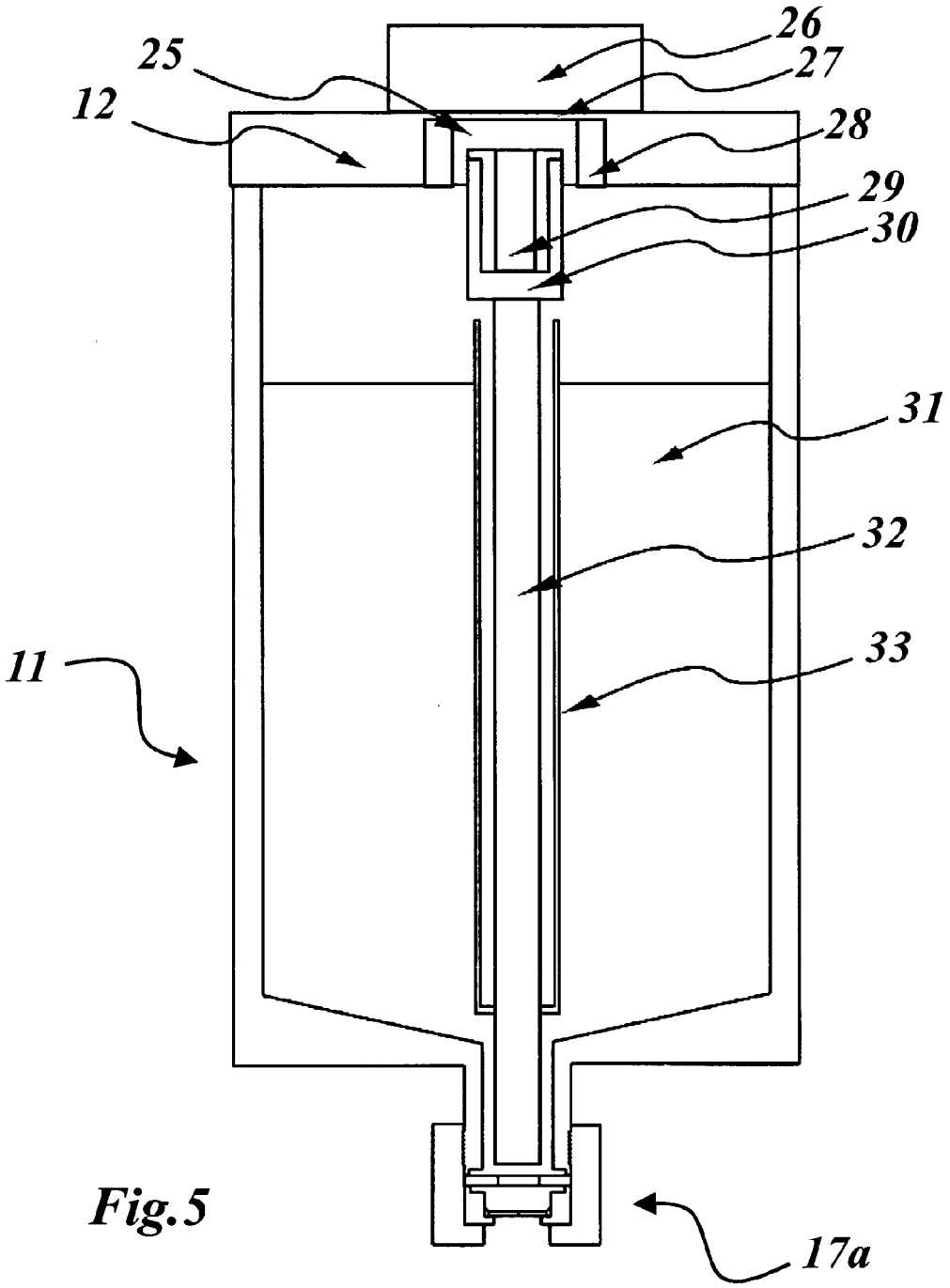
FIG. 5 shows a schematic cross-sectional view of the cartridge, including the actuated piston, the material reservoir and the outlet nozzle.

FIG. 5 presents a cross-section of the cartridge comprising the reservoir 11 and the outlet nozzle 17*a*. An actuated piston 32, which extends through the reservoir 11 and the molten material 31 contained therein, is attached to the removable cover 12 of the material reservoir 11 at one end via an intermediate piezoelectric (PZT) actuator 29. By applying a voltage to the PZT actuator 29, the other, free end of the actuated piston 32 is axially displaced in the molten source material 31 in a vibrating motion and generates pressure waves therein. These pressure variations propagate towards the exit of the outlet nozzle 17*a*. The predetermined frequencies of these pressure variations range from 1 kHz to 1000 kHz.

For continuous droplet generation, when the fluid is pressurized by means of a gas, a periodic signal is applied to the actuator 29. A Rayleigh type instability results in the break-up of the fluid column into droplets with the imposed frequency. Droplet volume is hereby a function of the characteristics of the fluid, backpressure, orifice diameter, and actuator driving parameters (voltage and timings).

The thermal management of the piezoelectric actuator 29 is crucial for long-term use of the droplet dispensing device. The maximum operating temperature of the piezoelectric material of the actuator 29 should not exceed 50% of the Curie temperature of the piezoceramic. In order to limit the heat flux from the molten source material 31, a heat shield 33 may be used surrounding the immersed section of the actuated piston 32. Heat, which flows along the axis of the piston 32 from the hot source material 31 at the free end of the piston 32, is preferably removed by a cooling system 26.

At the attachment point of the piston 32 and the removable cover 12, the heat flux from the piezoelectric actuator 29 may be confined, such that the cooling system 26 mainly removes heat from the piezoelectric actuator 29 and not from the removable cover 12. The heat path confinement may be realized by inserting a transition piece 28 made of thermal insulating and damping material, e.g. Polyether ether ketone (PEEK®), between a base plate 25 of the piezoelectric actuator 29 and the removable cover 12. The transition piece 28 and base plate 25 may be glued or flanged into the removable cover 12. The cooling system 26 may be based on convective cooling with a fluid, e.g. air, Ar, $N_2$, water. A conventional cooler provided for power electronics cooling may be used. The cooling system 26 may be placed inside or outside the material reservoir 11. In case, the cooling system 26 is placed outside the material reservoir 11, the heat path may include a membrane 27 in the removable cover 12 (see FIG. 5).

The actuated piston 32 may include a mechanical preload capability for the piezoelectric actuator 29. The base plate 25 of the piezoelectric actuator 29 may include a threaded end. By tightening a housing 30 of the piezoelectric actuator 29 to the base plate 25 with a predetermined torque, the preload of the actuator 29 may be set.

Figure 6:
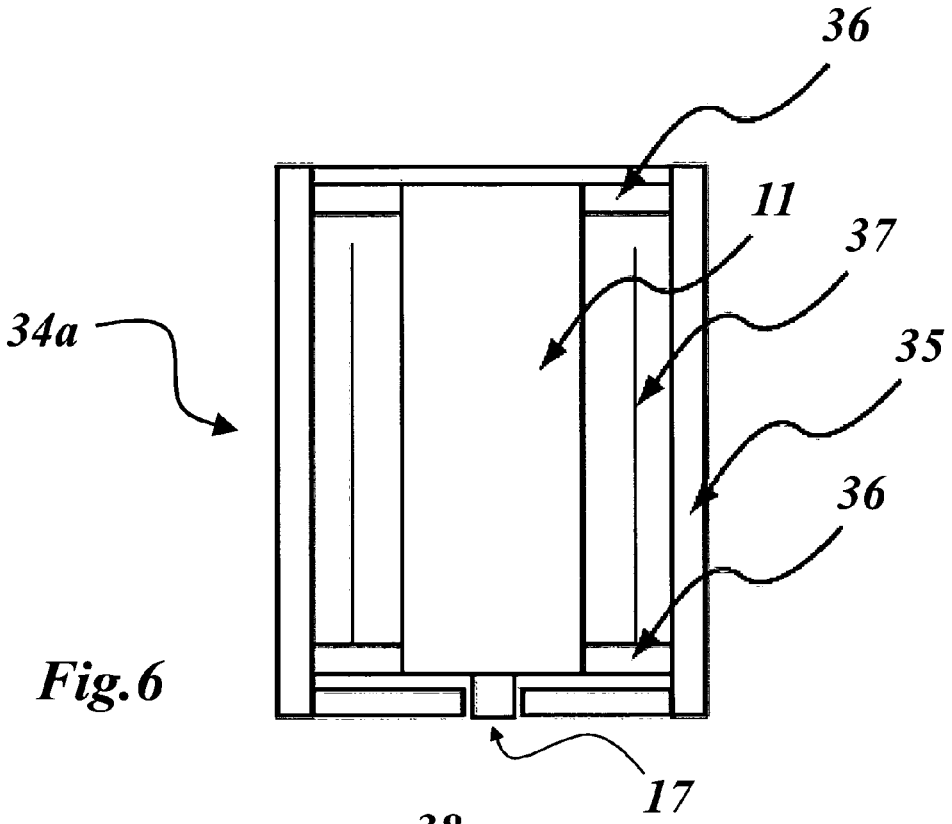
FIG. 6 shows a schematic view of the dispensing device inside the dispenser casing according to another embodiment of the invention.

As shown in FIG. 6, the droplet dispensing device 34*a* may be provided with a casing 35 for protection against plasma debris as well as for alignment purposes. The reservoir 11 with its outlet nozzle 17 may be contained between two flanges 36, as depicted in FIG. 6. The material of the flanges 36 may be a thermally insulating material, e.g. polytetrafluoroethylene (Teflon®), Polyether ether ketone (PEEK®), Macor, which reduces heat transfer from the cartridge 11, 17 to the casing 35. First, the insulating flanges 36 minimize the heating losses, hence the heating power can be reduced. Secondly, the lower temperatures at the casing 35 also imply a lower thermal gradient and hence a lower thermal expansion along the mechanical support of the dispensing device. A further coaxial heat shield 37 may be provided to reduce heat transfer between the cartridge 11, 17 and the casing 35.

Figure 7:
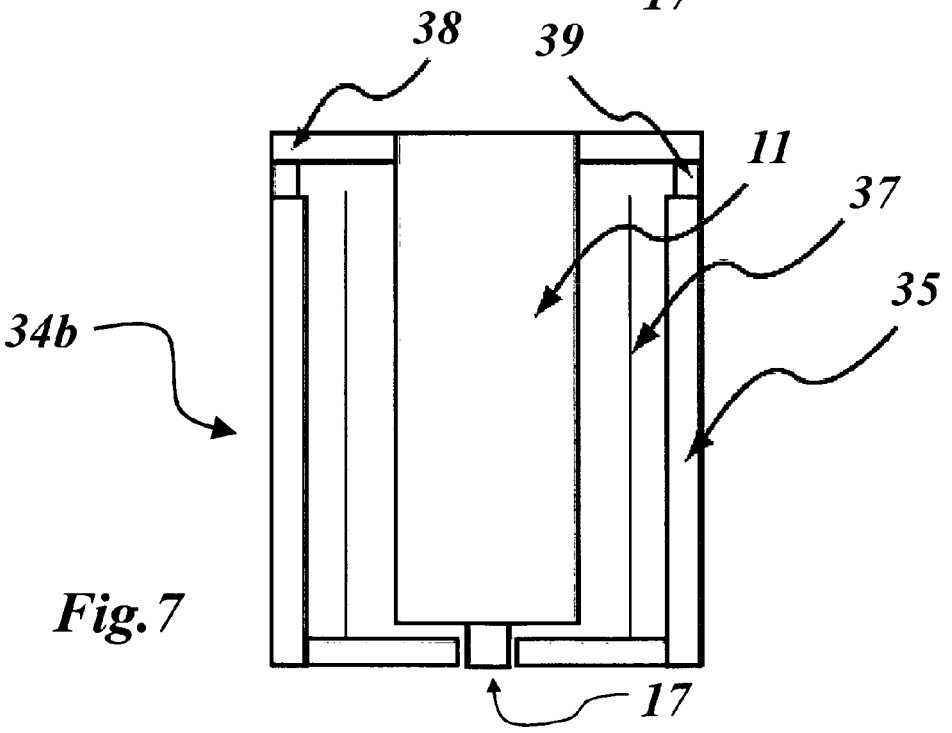
FIG. 7 shows a schematic view of the dispensing device, the dispenser casing and the piezoelectric actuators according to another embodiment of the invention.

Instead of the actuated piston 32, a piezoelectric actuator 39 may be integrated between the flange 38 and the casing 35, as shown in the droplet dispensing device 34*b* of FIG. 7. The piezoelectric actuator 39 axially displaces the whole device 11, 17. The resulting perturbations at the outlet nozzle 17 modulate the droplet stream at the desired frequency.

The embodiments of the present invention disclosed above are only preferred embodiments and do not limit the presented invention in any way and particularly not to a specific embodiment alone. Many changes and modifications can be made to the disclosed aspects of the embodiments described above. The following claims should cover not only the disclosed aspects of the embodiments described above but also apparent changes and modifications.

The invention claimed is:

1. A droplet dispensing device, comprising:

a reservoir for receiving a liquid material;

an outlet nozzle in fluid communication with said reservoir; and a piezoelectric actuating means (29, 30, 32) acting on said liquid material at said outlet nozzle such that said liquid material exits said outlet nozzle in a sequence of droplets at a constant repetition rate, wherein said piezoelectric actuating means comprises a piston, which is actuated by a piezoelectric actuator at one end and dips the other, free end into said liquid material just upstream of said outlet nozzle; wherein a free end of said actuated piston is axially displaceable in said liquid material in a vibrating motion such that pressure waves are generated in said liquid material and propagate towards the exit of the outlet nozzle.

2. The droplet dispensing device as claimed in claim 1, wherein said liquid material is a molten material and said reservoir is heated by a heating means to keep said molten material in the molten state.

3. The droplet dispensing device as claimed in claim 2, wherein said reservoir is surrounded by an outer cylinder and said heating means comprises a resistive heater, which is wound around said outer cylinder and said outlet nozzle thermally and mechanically fixed to said outer cylinder.

4. The droplet dispensing device as claimed in claim 2, wherein said reservoir and said outlet nozzle are enclosed by a band-heater.

5. The droplet dispensing device according to claim 1, wherein a filter is provided upstream of the outlet nozzle.

6. The droplet dispensing device according to claim 5, wherein said outlet nozzle, said piston, and said filter, respectively, are detachably coupled to said reservoir.

7. The droplet dispensing device according to claim 1, wherein said outlet nozzle is configured to deliver a continuous stream of droplets of said liquid material at a desired frequency when said piston is periodically excited by means of said piezoelectric actuator.

8. The droplet dispensing device according to claim 1, wherein said outlet nozzle comprises a separate nozzle disk, which is retained in a nozzle easing and is detachably coupled to said reservoir by a clamping device.

9. The droplet dispensing device according to claim 8, wherein said nozzle disk is made of a metal or ceramic and comprises a micro-machined nozzle orifice.

10. The droplet dispensing device according to claim 1, wherein said outlet nozzle comprises a one-piece nozzle unit, which is detachably coupled to said reservoir by a clamping device.

11. The droplet dispensing device according to claim 10, wherein said nozzle unit is made of a metal or ceramic and comprises a micro-machined nozzle orifice.

12. The droplet dispensing device according to claim 1, wherein means for applying a pressure to the liquid material in the reservoir is provided, so that said liquid material is urged from the reservoir into said outlet nozzle.

13. The droplet dispensing device according to claim 12, wherein said pressure applying means comprises a connector tube leading to the interior of said reservoir.

14. The droplet dispensing device according to claim 1, wherein said reservoir comprises a cover at a side opposite to said outlet nozzle, said actuated piston is mounted on said cover, and said piezoelectric actuator is arranged between said cover and said piston to generate displacements of said actuated piston in order to induce pressure waves in the liquid material at the outlet nozzle to impose a desired frequency to said sequence of droplets.

15. The droplet dispensing device according to claim 14, wherein a mechanical preload mechanism is provided for said piezoelectric actuator.

16. The droplet dispensing device according to claim 14, wherein a heat shield is provided for at least part of said piston, which reduces a heat flux from the liquid material to said piezoelectric actuator.

17. The droplet dispensing device according to claim 1, wherein said reservoir is suspended at a side opposite to said outlet nozzle in a casing by means of a thermally insulating flange and said piezoelectric actuator is arranged between the flange and the casing.

18. The droplet dispensing device according to claim 1, wherein said reservoir is provided with a cooling system for cooling the piezoelectric actuator to maintain a temperature of the piezoelectric actuator below detrimental temperatures.

19. The droplet dispensing device according to claim 18, wherein said cooling system is arranged outside said reservoir with a defined heat path to said piezoelectric actuator.

20. The droplet dispensing device according to claim 1, wherein said reservoir and said outlet nozzle are part of a replaceable cartridge, which is arranged in a casing and which is thermally insulated from said casing by insulating means.

21. A light source for producing extreme ultraviolet or soft x-ray light, comprising:

a chamber that contains a production site for producing extreme ultraviolet or soft x-ray light;

the droplet dispensing device of claim 1 for dispensing droplets of a liquid material into said production site, the liquid material being capable of radiating extreme ultraviolet or soft x-ray light when excited into a higher energy state; and irradiating means for irradiating the droplets at said production site.

22. The droplet dispensing device as claimed in claim 1, wherein driving means are provided, so that the piezoelectric actuator is driven by the driving means at predetermined frequencies from 1 kHz to 1000 kHz to generate said pressure waves.

* * * * *

UNITED STATES PATENT AND TRADEMARK OFFICE

CERTIFICATE OF CORRECTION

PATENT NO. : 9,307,625 B2
APPLICATION NO. : 14/110048
DATED : April 5, 2016
INVENTOR(S) : Bob Rollinger et al.

It is certified that error appears in the above-identified patent and that said Letters Patent is hereby corrected as shown below:

In the claims

Column 8, Line 25, Claim 8, delete "easing" and insert -- casing --

Signed and Sealed this
Fifth Day of July, 2016

Michelle K. Lee

Michelle K. Lee
*Director of the United States Patent and Trademark Office*